US005414328A

United States Patent [19]

Hunt et al.

[11] Patent Number: 5,414,328

[45] Date of Patent: May 9, 1995

[54] STAGE LIGHTING CONTROL CONSOLE INCLUDING ASSIGNABLE MACRO FUNCTIONS

[75] Inventors: Mark A. Hunt, Derby; Keith J. Owen, Moseley, United Kingdom

[73] Assignee: Light & Sound Design, Ltd., Edinburgh, United Kingdom

[21] Appl. No.: 77,862

[22] Filed: Jun. 18, 1993

[30] Foreign Application Priority Data

Nov. 19, 1992 [GB] United Kingdom ..... 9224287
Apr. 20, 1993 [GB] United Kingdom ..... 9308070

[51] Int. Cl.[6] ..... H05B 37/00

[52] U.S. Cl. ..... 315/316; 315/312; 315/314; 315/292

[58] Field of Search ..... 315/312, 314, 316, 292, 315/294, 324; 362/85, 233; 340/324 A

[56] References Cited

U.S. PATENT DOCUMENTS

| | | | |
|---|---|---|---|
| 3,706,914 | 12/1972 | Van Buren | 315/316 |
| 3,898,643 | 8/1975 | Ettlinger | 315/316 X |
| 4,716,344 | 12/1987 | Newell et al. | 315/312 |
| 4,772,825 | 9/1988 | Tabor et al. | 315/312 |
| 4,792,731 | 12/1988 | Pearlman et al. | 315/316 |
| 5,010,459 | 4/1991 | Taylor et al. | 315/316 X |
| 5,059,871 | 10/1991 | Pearlman et al. | 315/312 X |

FOREIGN PATENT DOCUMENTS

| | | |
|---|---|---|
| 0495305 | 7/1992 | European Pat. Off. . |
| 2231138 | 11/1990 | United Kingdom . |
| 2235310 | 2/1991 | United Kingdom . |
| WO89/05086 | 6/1989 | WIPO . |
| WO89/05421 | 6/1989 | WIPO . |

*Primary Examiner*—Robert J. Pascal
*Assistant Examiner*—Haissa Philogene
*Attorney, Agent, or Firm*—Fish & Richardson

[57] ABSTRACT

A control console for controlling stage lighting includes a panel on which there are mounted a multiplicity of control elements in the form of switches, slider potentiometers and others which can be used by an operator to input control data to the console and directly control remote lamp units connected to the console. The console includes a main cpu which forms part of an electronic control system which includes function allocation means enabling the operator to determine which one of the control elements exercises control over a particular independently controllable function of one or more of the lamps. The console also includes a data distribution unit which includes a plurality of separate serial communication controllers for communicating with respective ones of the lamps. An SCSI bus is used for transferring data between the main cpu and the distribution unit, which includes its own processor unit for distributing the data to the serial communication controllers.

17 Claims, 4 Drawing Sheets

STAGE LIGHTING CONTROL CONSOLE INCLUDING ASSIGNABLE MACRO FUNCTIONS

FIELD OF THE INVENTION

This invention relates to a console for controlling a stage lighting system.

BACKGROUND AND SUMMARY OF THE INVENTION

Conventional stage lighting control consoles make use of a plurality of control elements arranged on a panel and each controlling a specific function of the console. The control elements may include push-button or multi-position switches, and rotary and linear motion potentiometers. The designer of the console decides during the design operation exactly what lighting function each switch or potentiometer will control and the operator of the console has very little choice about how he uses the console.

Modern stage lighting has become more and more complex in recent years and consoles are required to control a large number of different functions. A lighting unit may, for example, have built in systems for remote control of intensity, beam direction, beam spread, colour variation, gobo positioning and rotation and other functions. Lighting designers require to make use of all these functions in different combinations and it has therefore become very difficult to provide an ergonomic console layout which will satisfy all the lighting designers varying needs.

It is therefore an object of the present invention to provide a control console which is capable of being readily reconfigured to allow it to be used in a variety of different ways.

In accordance with the invention there is provided a stage lighting control console including a panel, a plurality of control elements mounted on said panel and including manually actuable switch elements and manually adjustable control elements and an electronic control system controlled by said switch element and manually adjustable control elements for producing output signals for controlling a multiplicity of independently controllable functions of a plurality of remote lamp units, said electronic control system including function allocation means for determining which of the switch elements and manually adjustable control elements exercise control over each one of the functions of the lamp units, said function allocation means being under the control of a user of the console utilizing selected ones of the switch elements.

The individual switch elements may incorporate in built display devices which are controlled by the electronic control system to provide a display appropriate to the current function of the switch element.

The panel may also include a plurality of further display areas adjacent individual switch elements or control elements or adjacent groups of such element to display alphanumeric information indicating the current function of the associated switch or control element or the associated group of such elements.

Preferably, the panel comprises a plurality of sub-panels each with a different arrangement of switch elements, control elements and display areas, each sub-panel having its own associated processor unit for controlling the display areas of that sub-panel and the console including a main processor unit which communicates with the sub-panel processor units.

With this arrangement, the user is able to determine for himself the relative locations of the sub-panels.

Preferably, there is provided a dual-port memory unit which is connected to the main processor unit and to all the sub-panel processor units, such memory unit being used to store switch and control element operation data and display data, the main processor unit reading from the memory unit the switch and control element operation data and writing to the memory unit display data, and the sub-panel processor units writing switch and control element operation data to the memory unit and reading therefrom the display data.

The invention also resides in a stage lighting console comprising the combination of a panel, a plurality of user input control elements on said panel, a main processor unit for processing data input by a user to generate a multiplicity of data message blocks to be sent respectively to a multiplicity of individually controllable lamp units, and a distribution unit including a multiplicity of individual serial communication controllers for connection to respective ones of the lamp units, first data bus means connecting said main processor unit to said distributor unit for transferring said message data blocks to said distribution unit and second processor means for distributing the data contained in said message data blocks to said individual serial communication controllers.

Preferably, the main processor unit has main RAM in a portion of which it stores said message data blocks, and said distribution unit has a plurality of blocks of dual port RAM into which the contents of said portion of the main RAM can be copied over said first data bus under the control of said second processor means.

For controlling transfer of data from the blocks of dual port RAM to the associated serial communication controllers, there are preferably a plurality of third processors units each associated with a different one of the blocks of dual port RAM and with a different group of the serial communication controllers.

Each of said third processor units is programmed to transfer data from the associated block of dual port RAM to the serial communication controllers of the associated group in an interleaved byte-by-byte fashion, each serial communication controller transmitting each byte on receipt thereof.

BRIEF DESCRIPTION OF THE DRAWINGS

An example of the invention is shown in the accompanying drawings, in which.

DESCRIPTION OF THE PREFERRED EMBODIMENT

Figure 1:
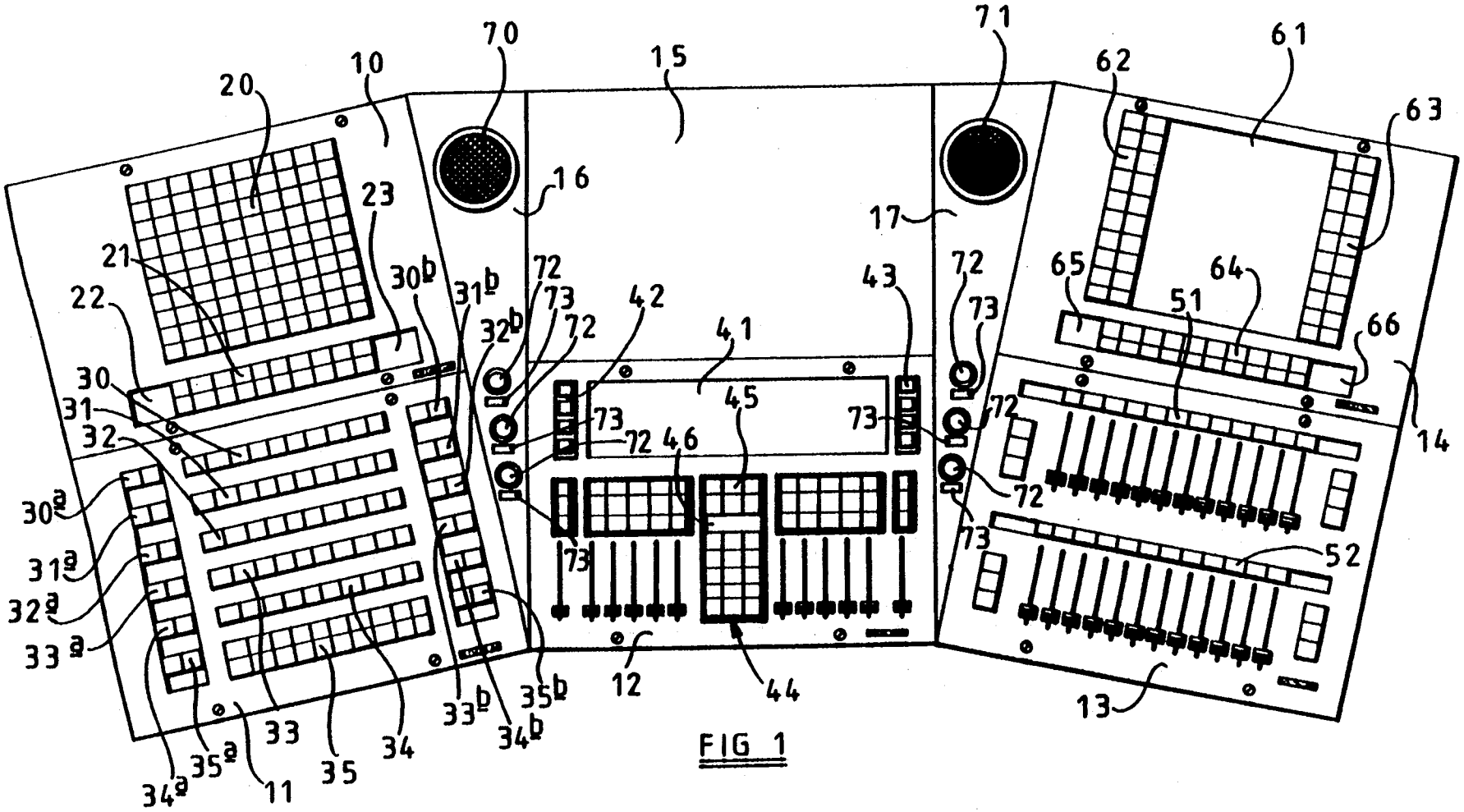
FIG. 1 is a diagrammatic view of the panel of the console.

The panel shown in FIG. 1 includes five separate sub-panels 10, 11, 12, 13 and 14, together with a blank sub-panel 15 and two wedge shaped panel pieces 16 and 17.

Mounted on the various sub-panels are a variety of switch elements, manually operable control elements, (such as slider-type potentiometers and rotary encoders) and a plurality of display areas.

Each of the switch elements used is of the same type incorporating a push-button with an inset dot matrix LCD display capable of displaying numbers, alphabetic characters and graphic symbols and back lighting LED's. Red and Green LED's are incorporated and these can be illuminated at different levels so as to enable the switches to be illuminated at different levels in different colours in the red-yellow-green colour range as required. The display areas make use of multi-segment LED alphanumeric display elements.

Sub-panel 10, which is used for selecting the lamp channel or channels to be controlled by subsequent actions, has a 10×10 bank 20 of the switch elements and two additional rows of ten switch elements. The switches in the 10×10 bank are arranged to display symbols, such as the numbers between 1 and 100. The sub-panel 10 also includes two of the display areas 22, 23 at opposite ends of double row of switch elements. Each of these display areas can display two rows of eight characters.

The sub-panel 11 has five single rows 30 to 34 of ten of the switch elements and a double row 35 of switch elements. Aligned with each of the five rows 30 to 34 are pairs of the switch elements 30_$^a$, 30_$^b$ to 34_$^a$, 34_$^b$ at opposite sides of the sub-panel and two more pairs of switch elements 35_$^a$ and 35_$^b$ are similarly associated with the double row 35. 34$^b$ at opposite sides of the sub-panel and two more pairs of switch Thus there are twelve of these pairs of switches altogether and there is a separate eight-character display area adjacent each switch pair. FIG. 1 shows these display areas arranged beneath respective switch pairs, but each display area is preferably above the associated switch pair so that the display area is non-concealed by the hand of the user operating the switch elements.

Sub-panel 12 includes a display area 41 fifty six characters wide by four characters high. Vertical rows 42, 43 of four switch elements are arranged at opposite sides of this area 41. In the centre of sub-panel 12 there is a numeric key pad 44 made up of a five by three array of the switch elements. Between this and the area 41 is a double row 45 of three switch elements and a twelve character wide single row display area 46. On each side of the numeric key-pad is an array of six slider potentiometers and a six by three array of the switch elements.

Sub-panel 13 has two rows 51, 52 of twelve of switch elements, with two rows of twelve slider potentiometers below the respective rows of switch elements. There are four vertical rows of three switch elements. At the ends of each of the rows of twelve switch elements there are display areas each providing an eight character display.

Finally, sub-panel 14, includes a large display area 61 which can display ten rows of 28 characters. A single or (as shown) double vertical row 62, 63 of ten switch elements is arranged at each side of area 61 and there is a double horizontal row 64 of switch elements below the area 61, with a two row by eight character display area 65, 66 at each end.

In the two wedge panel portions 16 and 17 there are provided a pair of loudspeakers 70, 71, a number of rotary digital encoders 72 and a like number of alphanumeric LED display areas 73 adjacent respective encoders.

Figure 2:
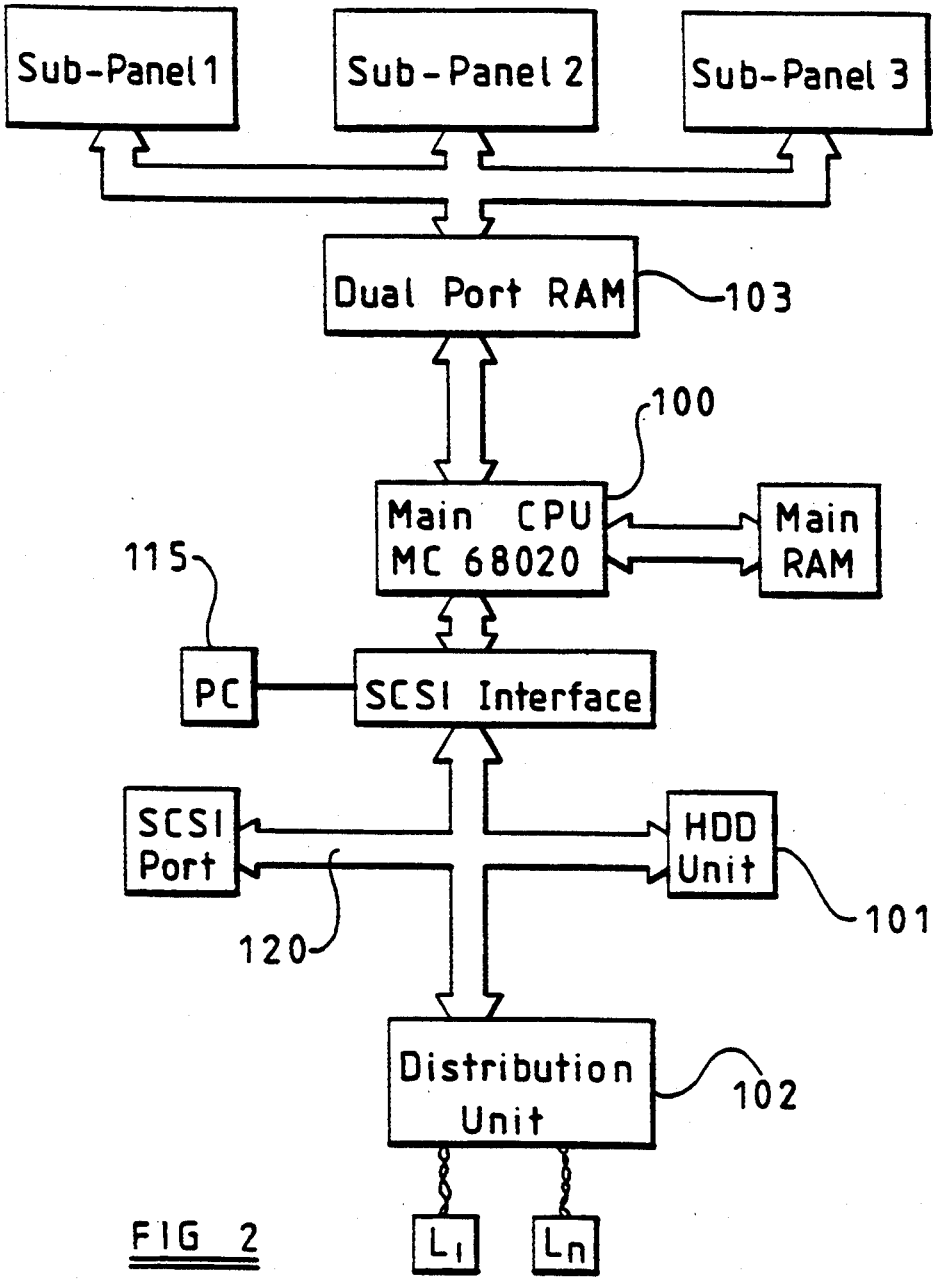
FIG. 2 is a schematic diagram of the control system.
Figure 3:
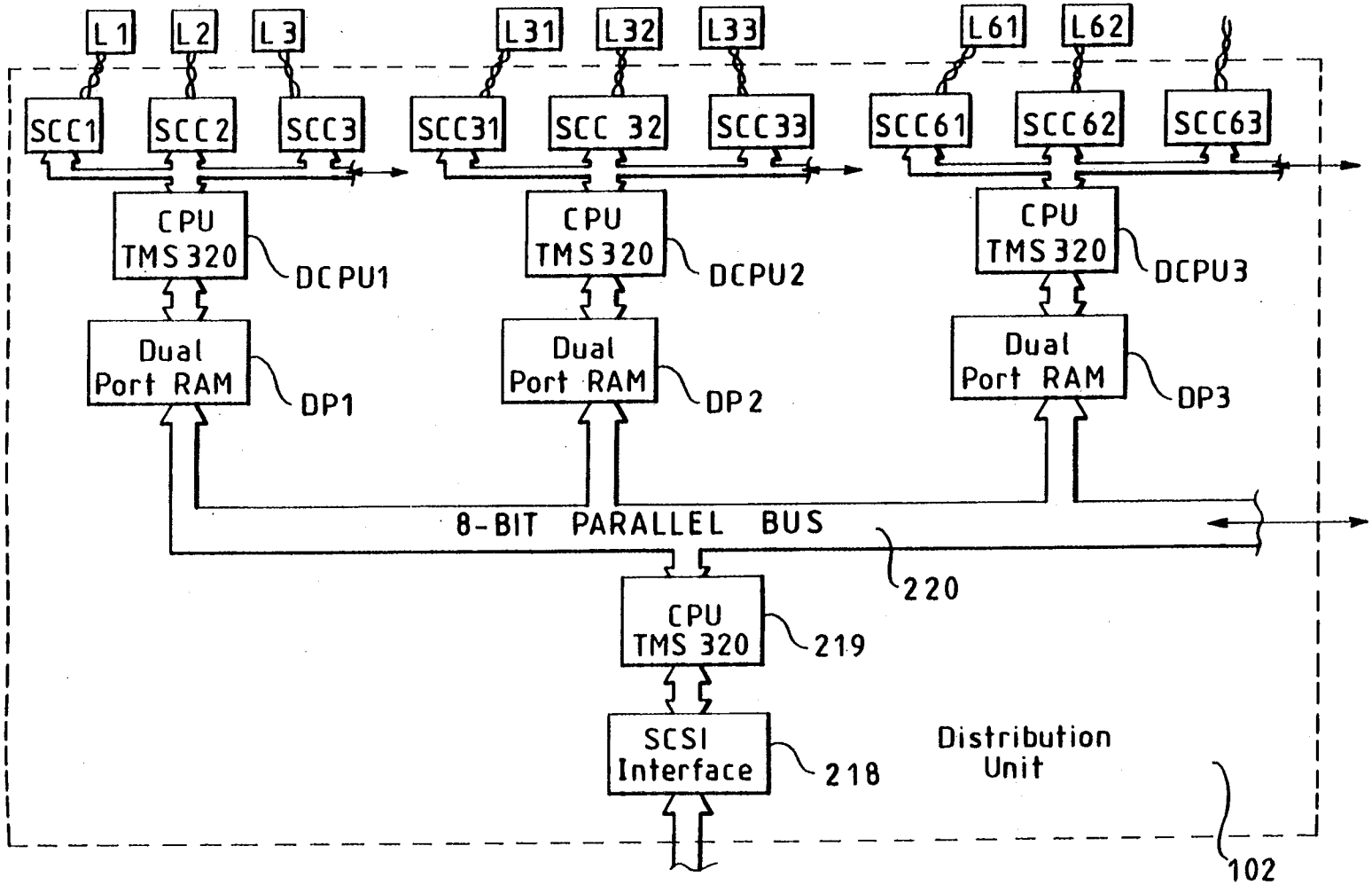
FIG. 3 is a schematic diagram of a distribution unit which is shown in FIG. 2.

Referring now to FIG. 2, the electronic control system shown includes a main CPU 100 which accepts input from the switch elements, potentiometers and encoders, as well as from a hard disk drive 101 on an SCSI bus which is also connected to an SCSI port, to which, if required, a personal computer 115 having an SCSI port can be connected for programming the system, reading from or writing to the hard disk unit, or taking over from the main cpu 100 in cases of failure of the console. The SCSI bus is also connected to a distribution unit 102 shown in more detail in FIG. 3.

The main console cpu 100 creates messages to be sent to the individual lamps, each message comprising a fixed number of bytes for each lamp. The messages contain data relating to the parameters of the lamp, which parameters can include required lamp orientation, beam coloration, iris diaphragm diameter, gobo selection and rotation, zoom projection lens control and opening or closing of a shutter included in the lamp. A block of the RAM of the main cpu is set aside for the storage of these messages, the block being large enough to contain messages for 240 lamps, being the largest number which can be controlled via the distribution unit. Where it is required to control more than 240 lamps additional distribution units can be connected to the SCSI bus and extra main cpu RAM reserved for message storage. When any message data is changed the main cpu 100 sets a flag in the RAM block which is detected at a given point in the main cpu program loop and interpreted as a signal that the changed message data is to be transferred to the distribution unit 102.

The distribution unit 102 has a main cpu 219 which controls reception of data from the SCSI bus interface and distribution of such data to up to eight blocks of dual,port memory DP1, DP2, DP3 . . . via an eight bit data bus 220. The cpu 219 is alerted to the waiting message data when cpu 101 selects the distribution unit. The cpu 219 then supervises byte by byte transfer of the message data which it routes to the various blocks of dual port memory.

For actually sending out the message data to the lamps, there are a plurality of serial communication controllers SCC1 to SCC30, SCC31 to SCC60 etc, there being thirty serial communication controllers associated with each block of dual port memory. A further cpu DCPU1, DCPU2, etc is associated with each block of dual port memory and distributes message data transferred to the dual port memory to the individual serial communication controllers and the messages are transferred to the lamps. Each serial communication controller in the distribution unit includes a line driver which is disabled except when data is to be transmitted. Enabling of the driver can cause a spurious signal to be transmitted over the data link. To allow such spurious signals to be identified and ignored, a two-byte gap is left between enabling the line driver and commencing transmission of the message data for the channel in question. This is described in more detail in the co-pending application of even date entitled "Stage Lighting Lamp Unit and Stage Lighting System Including Such Unit" of Hunt, Owen and Hughes, Ser. No. 08/077,877.

Each of the cpus eg DCPU1, transfers data from the associated dual port RAM DP1 to the serial communication controller SCC1 to SCC30 with which it is associated one byte at a time, ie the first byte for SCC1 is transferred followed by the first byte for SCC2 and so on, each serial communication controller commencing transmission as soon as it has received its byte of data. The serial communication controllers operate to transmit data at 230.4 Kbps so that it takes about 35 μs to transmit each byte. Transfer of data from the dual port RAM DP1 to the serial communication controllers is, however, at a rate of several Mbps, so that the transmissions from all the serial communication controllers are almost simultaneous. The cpu DCPU1 is not required to monitor the transmission of data by the serial communication controller, but utilizes a software timer to commence transfer of the second byte to the serial communication controllers. This timer is started when transfer of the byte of data to the last serial communication controller SCC30 has been completed and its time-out duration is slightly longer than the byte transmission time, say 40 μs. Transmission of all the messages takes about 1.5 ms out of a distribution unit main program loop duration of 4 ms.

The main CPU also controls the LCD matrix displays in the various switch elements and the alphanumeric LED display areas of the panels.

Figure 4:
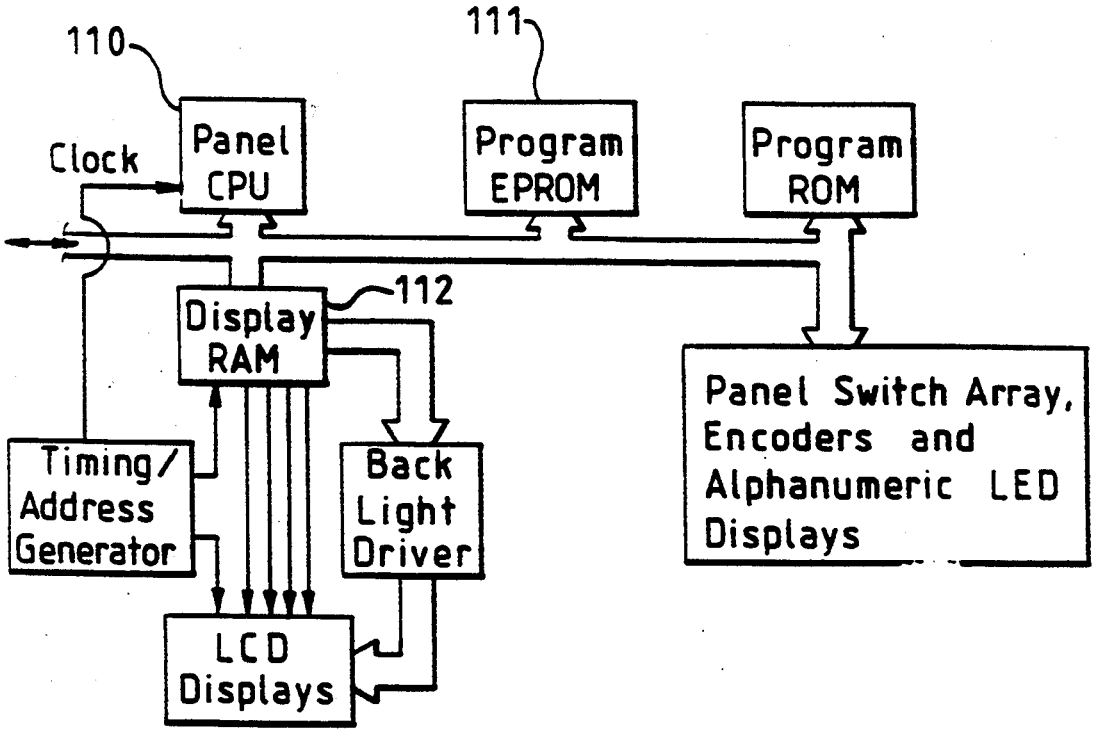
FIG. 4 is a schematic diagram of the control system for a single subpanel of the panel shown in FIG. 1.

As shown in FIG. 4, each sub-panel has its own local CPU 110 which is connected by a data bus to a block of dual port RAM 103 (FIG. 2) which is also connected to the main CPU. The dual port RAM 103, has a range of addresses for each of the panels and, within the range reserved for each panel, there is stored both switch element and control element data to be conveyed from the panel to the main CPU and display data to be conveyed to the panel CPU. Each panel CPU has its own operating program stored in EPROM 111, such program being matched to the configuration switch elements, control elements and display areas on the panel. The LCD matrix displays and their backlight LEDs are controlled by display RAM 112 which is refreshed periodically by the CPU 110. A multiplexing arrangement is used to drive the LCD matrix elements and the backlight LCDs. The CPU 110 polls the various switch elements and control elements on its panel and writes data relating to the current status of these into the dual port RAM area reserved for this data. The CPU 110 also controls the LED alphanumeric display areas on its panel.

Those of ordinary skill in the stage lighting art understand that a cue represents a prestored set of parameters for a particular lamp. For example, cue number 10 for lamp number 12 might indicate that lamp number 12 should go to specified pan and tilt positions, and should be controlled to have specified values of iris, intensity, etc., whenever cue number 10 is executed. Cues must be recorded in advance: and sometimes this is done by setting the lamp manually to the desired parameters and executing a cue record command.

The main CPU 100 polls the dual port RAM periodically for key-press events and changes in the outputs of the control elements. The data received in this way used either to set up dialogs with the user concerning the control actions he wishes to take, or, if no dialog is necessary or the dialog is complete, to write data to the hard disk drive or send it out over the network.

The main CPU software includes a panel manager routine which is responsible for collecting all keypress events, wherever they occur on the sub-panels. Each area has its own rules/methods regarding keypress events.

The "select" area on sub-panel 10 is used to select which of the lamps will be influenced by the cue record being assembled and a selection manager module is passed all data related to keypress events in this area. The selection manager maintains its own map of which lamp channels are currently selected. Whenever one of the select keys is pressed the corresponding channel status in this map is changed. If the channel was previously selected it is deselected and vice versa. If one key in the 10×10 array is pressed and held and another key is then pressed, all the channels between those represented by the two keys are selected. If a particular key is "double-clicked" (i.e. pressed twice within a given time) the associated channel is selected and all others are deselected. The selection manager outputs channel status data to the dual port memory so that only the keys associated with selected channels are highlighted (i.e. illuminated bright yellow instead of low level red).

The numeric key pad area 44 is used to control a cue manager software module. Entry of a valid (non-zero) number on the key pad followed by a press of an "ENTER" key will make a cue record with that number the current cue, creating a new cue if one does not already exist. There are also "NEXT" and "LAST" keys which call up the next and previous cues respectively. None of these key actions executes the chosen cue, but merely makes it current. Pressing of a "GO" key causes the cue to be executed.

The sub-panel 11 contains the groups of switch elements which are the most likely to be reassigned to different tasks by different users. There are effectively six groups of keys in this area, each group containing two key pairs and ten (or twenty) keys in between the two pairs. The pairs and the row may be used individually or grouped together.

In the individual mode each of the two pairs of keys may control a different lamp function. Pressing the left hand key decreases the value assigned to that function, while pressing the right hand one increases the value. Holding down either key causes the function value to accelerate in the appropriate direction. Releasing the key stops the value changing. Double-clicking the key sets the value to its maximum or minimum. In the same mode, a central group of ten (or twenty) keys acts as a group of eight (or eighteen) preset value keys, with the two left hand keys acting as scroll keys, so that more than eight (or eighteen) preset values can be accessed.

In the combined mode, the row(s) are all preset select keys, while the right hand key pair control scrolling. The left hand key pair can be assigned to a different function.

A function allocation means allows the user to choose which functions are to be allocated to which keys and which mode to use. He may therefore choose functions which have the maximum control facility and which are to have minimal control. Assignment of these keys may be made whilst a performance is actually in progress. Selected functions may be moved to manual control for a part of the performance.

This functionality is assigned as follows. The CPU maintains a map between each key and the function that it will command. The CPU executes the command from the map whenever the associated key is actuated. If the key function is reassigned, the CPU modifies this map so that later actuations of that key cause the different, reassigned function to be executed.

The panel manager software module handles most keypress events in the sub-panel 11. To control the lamp functions, the panel manager module sends data to an appropriate one of a plurality of function driver modules tailored to the requirements of that function. The panel manager keeps track of which preset keys are assigned to which driver, so that when a particular key is pressed, the panel manager can pass data to the appropriate driver. When it is a preset key which has been pressed, the panel manager calculates the preset number based on the current scroll position and makes a call to the appropriate driver module which returns the appropriate preset value. The panel manager retrieves data identifying the currently selected lamp channels from the map which is maintained by the selection manager and makes another call to the driver passing to it the preset number and the data identifying the lamps selected. The driver module uses this data to assemble a message to be passed to the lamps over the network. A copy of the message is also passed to the cue manager so that it can be recorded if required.

Whenever a scroll key is pressed, the panel manager sends an enquiry message to the driver module asking for a name for each key in the new preset list. This allows the names and preset values to be stored in the driver module's private data area—which may be in a disk file or in RAM.

The driver module has a name field which is stored at a predetermined offset from the start address of the driver module. The panel manager can call up this name from the driver and pass it to the dual port memory for display.

In more detail, the following sequence of events occurs. The panel manager repeated makes calls to a "GETKEY" routine to see whether any keypress events are pending. If an event is pending "GETKEY" returns the key number. The panel manager uses this number to look up the key in a key translation table, which contains a key type number and a key value. The key type identifies the key as belonging to a particular functional group of keys, such as "select" keys, "manual" keys and "number" keys. The key value identifies the key within its type. The key type determines which of a number of different routines is next executed. If the key was a "manual" key, the key value passed indicates to the manual handler routine whether it is in either of the two scroll pairs, or in a preset select row. The handler routine uses the key value to select a "manual control record" relating to the appropriate group of keys, which record contains all the information needed to perform the actions required. In particular it contains the number of the driver module(s) associated with each of the three areas of the manual key group.

The handler routine can determine the mode of the group by comparing the driver numbers of the three areas. If the right scroll driver is the same as the preset driver, for instance, the handler recognises that the right scroll keys are scroll keys for the group. If it is either of these that is pressed the handler calculates the index of the next group of presets and calls the driver once per preset key to provide a name for each key to display.

If the key was a "PRESET" key, the handler calculates the index value of the key, and calls the driver to determine the preset value assigned to the key. This allows the driver to maintain its own private storage in appropriate format. The handler then calls the driver again, using the returned value to output the value to the selected lamps. The selection bitmap, the time to execute and the value are supplied in a "stack frame" within the call. The same parameters, plus the driver number, are supplied to the cue manager so that the call can be recorded in the cue list.

When recorded cues are replayed, the cue manager replicates the event directly by interacting with the driver, making the dialog between the handler and the driver unnecessary.

There are many functions which involve changing the state of console parameters during a performance. These may range from executing a cue which is not the next in the numerical sequence to re-arranging the manual driver assignment. The functions are managed by a console driver module which operates as a function allocation means. A scrollable list of function keys and may be sited on any manual group. Each "page" of this driver accesses different functions, thereby allowing cue management, console re-arrangement and other functions to be carried out. This arrangement gives the advantage of enabling the storage of these actions as part of a cue. Manual assignments stored in this way become part of the cue and will be repeated when the cue is replayed. The desired assignments will become part of the performance and will be made available to the operator at the correct point in the execution of the cue list.

Assignment of the potentiometers to master control of cues is also achieved through the console driver.

The various potentiometers in sub-panels 12 and 13 serve the same logical function. Each control group consists of a potentiometer with at least one associated key switch element. The console driver allows the user to allocate the function of any potentiometer to master control of any masterable function—i.e. any function which performs an action which may include an execution time. The master control provides a manually controlled (instead of timed) transition between prior and new values of a selected function.

Most console functions have more than one mode, affecting how the actions selected will be performed. These modes are specific to each driver and are handled on a driver by driver basis. This handling is the responsibility of the panel manager.

When a driver control key on the sub-panel 11 is pressed, the panel manager checks the state of "MODE" key in the set of keys 45 above the numerical key pad 44. If this key is being held down, the panel manager sends a "set mode" message to the driver, which then conducts a dialog with the user to ascertain which mode is to be established. This dialogue uses the display area 41.

Editing of driver presets (i.e. changing the values stored) is carried out when a preset select key is pressed while an "EDIT" key in key set 45 is held down. The driver then conducts a dialog with the user to allow editing. Preset values can be entered manually using the numeric keypad, or using one of the encoders 72.

Two additional patentable aspects of the present invention are also contemplated as supplemental aspects of the above. The first is the macro command. As least some of the keys on the keyboard may be assigned as a macro key. Depressing that particular key commands a plurality of different sub-functions to be executed. This is carried out by associating a function sequence in the map with the key. Subsequent actuations of the macro key command a read and execute of the commands that are previously stored and are associated with that key sequence. The stored commands are executed in the order stored—optionally at times which are also set into the map. For example, the map might appear as follows:

| (Key # | function | parameter | function | parameter) |
|---|---|---|---|---|
| <11> | <E42> | <1FH> | <OFF> | <01> . . . |

indicating that key number 11 executes function E42, parameter 1Fh etc. One function, e.g. OFF, indicates a delay by the amount of the parameter that follows.

This is highly advantageous especially when combined with a allocatable keyboard: since it may be possible to configure the keyboard to eliminate some functions from it entirely. Instead, some functions could only be executed via a macro key. For instance, if function 1 will always be followed by functions 2, 3, and 4, the keyboard need not be programmed to include functions 1, 2, 3, and 4 separately. Instead, during initial setup, these functions are programmed into a single macro key. Only the macro key need later be depressed, and no separate depressions of the separate keys are necessary.

A second advantageous aspect of the present invention is the snapshot feature. The prior art has taught storage of cues, where each cue represents a particular state of a particular light. The inventors of the present invention have found that sometimes a unique lighting effect might be created by the entire system of lights, and that one might want to recreate this overall effect. In the past, it has been necessary to take notes about how this unique effect was determined. According to the present invention, a "snapshot" function is available, to memorize all positions and all parameters of all lights. This is done according to the present invention by making a copy of the contents of the entire block of main RAM, which stores all of the information for all lights. These contents are assigned a snapshot number, which may be executed by a recall snapshot key. A recall of the snapshot memorized in this way allows the entire unique effect to be recalled and displayed at any desired time.

We claim:

1. A stage lighting control console including a panel, a plurality of control elements mounted on said panel and including manually actuable switch elements and manually adjustable control elements and an electronic control system controlled by said switch element and manually adjustable control elements for producing output signals for controlling a multiplicity of independently controllable functions of a plurality of remote lamp units, said electronic control system including function allocation means for determining which of the switch elements and manually adjustable control elements exercise control over each one of the functions of the lamp units, said function allocation means being under the control of a user of the console utilizing selected ones of the switch elements.

2. A stage lighting control console as claimed in claim 1 in which the individual switch elements incorporate in built display devices which are controlled by the electronic control system to provide a display appropriate to the current function of the switch element.

3. A stage lighting control console as claimed in claim 2 in which the panel also includes a plurality of further display areas adjacent individual switch elements or control elements or adjacent groups of such elements to display alphanumeric information indicating the current function of the associated switch or control element or the associated group of such elements.

4. A stage lighting control console as claimed in claim 1 in which the panel comprises a plurality of sub-panels each with a different arrangement of switch elements, control elements and display areas, each sub-panel having its own associated processor unit for controlling the display areas of that sub-panel and the console including a main processor unit which communicates with the sub-panel processor units.

5. A stage lighting control console as claimed in claim 4 in which there is provided a dual-port memory unit which is connected to the main processor unit and to all the sub-panel processor units, such memory unit being used to store switch and control element operation data and display data, the main processor unit reading from the memory unit the switch and control element operation data and writing to the memory unit display data, and the sub-panel processor units writing switch and control element operation data to the memory unit and reading therefrom the display data.

6. A stage lighting control console comprising the combination of a panel, a plurality of user input control elements on said panel, a main processor unit for processing data input by a user to generate a multiplicity of data message blocks to be sent respectively to a multiplicity of individually controllable lamp units, and a distribution unit including a multiplicity of individual serial communication controllers for connection to respective ones of the lamp units, first data bus means connecting said main processor unit to said distributor unit for transferring said message data blocks to said distribution unit and second processor means for distributing the data contained in said message data blocks to said individual serial communication controllers.

7. A stage lighting control console as claimed in claim 6 in which the main processor unit has main RAM in a portion of which it stores said message data blocks, and said distribution unit has a plurality of blocks of dual port RAM into which the contents of said portion of the main RAM can be copied over said first data bus under the control of said second processor means.

8. A stage lighting control console as claimed in claim 7 in which there are a plurality of third processors units for controlling transfer of data from the blocks of dual port RAM to the associated serial communication controllers,each of said third processors being associated with a different one of the blocks of dual port RAM and with a different group of the serial communication controllers.

9. A stage lighting control console as claimed in claim 8 in which each of said third processor units is programmed to transfer data from the associated block of dual port RAM to the serial communication controllers of the associated group in an interleaved byte-by-byte fashion, each serial communication controller transmitting each byte on receipt thereof.

10. A console as in claim 1 wherein said function allocation means includes means for assigning a plurality of different functions to a single actuable switch element, such that actuation of said actuatable switch element causes execution of said plurality of functions in the same order as that in which they were stored.

11. A console as in claim 1 further comprising a snapshot control mechanism, which when actuated causes parameters for a plurality of said multiple lamp units to be stored in a way such that they can be later recalled.

12. A console as in claim 11 wherein said snapshot control mechanism includes means for storing data from all of said lamp units and one of said switch elements can be allocated by said function allocation means to initiate a recall of any particular snapshot.

13. A stage lighting control system for controlling a plurality of remotely-controllable lamp units, comprising:

a plurality of control elements for commanding control of parameters of said lamps;

a memory area, having a plurality of memory elements, said memory elements storing a value indicative of characteristics of parameters of said lamps;

a processor which receives commands from said plurality of control elements, and responsively alters values in said memory elements based on said commands, and which produces control signals for the lamp units based on the values in the memory area;

a snapshot store control element which, when actuated, commands a snapshot store command whereby all values of all of said memory elements are stored in a memory location other than in said memory element, for later recall; and a snapshot recall control element which when actuated commands recall of a stored snapshot, said processor including:

a storage control element which stores said all values of said all of said memory elements in said other memory location responsive to said snapshot store command and which reads out said values responsive to said snapshot recall command.

14. A stage lighting control system as in claim 13, wherein said processor stores a map indicating what specific functions are controlled by each of said control elements, and includes an element for altering said map to allow reconfiguration of said control elements to command different ones of said specific functions, said specific functions including said snapshot store command and said snapshot recall command.

15. A stage lighting control system for controlling a plurality of remotely-controllable lamp units, comprising:

a plurality of control elements for commanding control of parameters of said lamps;

a lighting memory area, having a plurality of memory elements, each of said memory elements having a value indicative of characteristics of parameters of said lamps;

a processor which receives commands from said plurality of control elements, and responsively alters values in said memory elements based on said commands, and which produces control signals based on the values in the memory area; and a macro recall control element which when actuated commands recall of a stored sequence of commands, and causes execution of said sequence of commands by said processor.

16. A stage lighting control system as in claim 15, further comprising a macro store control element which, when actuated, memorizes a sequence of said commands, and stores said sequence in a memory location other than said lighting memory area, for later recall.

17. A stage lighting control system as in claim 15, wherein said processor stores a map indicating what specific functions are controlled by each of said control elements, and includes an element for altering said map to allow reconfiguration of said control elements to command different ones of said specific functions, said specific functions including said macro store command and said macro recall command.

* * * * *